US007966751B2

(12) United States Patent
Durand

(10) Patent No.: US 7,966,751 B2
(45) **Date of Patent: *Jun. 28, 2011**

(54) SOLE WITH EXTENSIBLE STRUCTURE

(75) Inventor: Jean-Jacques Durand, Cholet (FR)

(73) Assignee: EXTEN.S, Cholet (FR)

( * ) Notice: Subject to any disclaimer, the term of this patent is extended or adjusted under 35 U.S.C. 154(b) by 0 days.

This patent is subject to a terminal disclaimer.

(21) Appl. No.: 12/576,744

(22) Filed: Oct. 9, 2009

(65) Prior Publication Data

US 2010/0024249 A1 Feb. 4, 2010

Related U.S. Application Data

(63) Continuation of application No. 11/603,150, filed on Nov. 22, 2006, now Pat. No. 7,621,058, which is a continuation of application No. 10/475,933, filed as application No. PCT/FR02/01366 on Apr. 22, 2002, now Pat. No. 7,155,845.

(30) Foreign Application Priority Data

Apr. 27, 2001 (FR) ..... 01 05702

(51) Int. Cl.
*A43B 3/26* (2006.01)

(52) U.S. Cl. ..... 36/97; 36/25 R; 36/30 R

(58) Field of Classification Search ..... 36/97, 25 R, 36/30 R, 28, 31, 130, 43, 44
See application file for complete search history.

(56) References Cited

U.S. PATENT DOCUMENTS

| | | | |
|---|---|---|---|
| 0,997,657 | A | 7/1911 | Drake |
| 2,211,509 | A | 8/1940 | Lumbard |
| 2,252,315 | A | 8/1941 | Doree |
| 2,931,110 | A | 4/1960 | Pietrocola |
| 3,161,970 | A | 12/1964 | Purtell |
| 3,591,879 | A | 7/1971 | Stapleton |
| 3,609,888 | A | 10/1971 | Rickman |
| 3,624,930 | A | 12/1971 | Johnson et al. |
| 3,629,961 | A | 12/1971 | Seif |
| 3,705,463 | A | 12/1972 | Lown |
| 3,724,105 | A | 4/1973 | Weight |

(Continued)

FOREIGN PATENT DOCUMENTS

EP 401108 A1 12/1990

(Continued)

OTHER PUBLICATIONS

Acor Orthopaedic, Inc., Poron [online], http: // www. acor.com/ poron.htm, [retrieved on Jun. 5, 2001], pp. 1/3-3/3.

(Continued)

*Primary Examiner* — Ted Kavanaugh
(74) *Attorney, Agent, or Firm* — Westerman, Hattori, Daniels & Adrian, LLP

(57) ABSTRACT

Sole with stretchable structure, in which the forepart is associated with a stretchable material to fit differing foot widths easily; and footwear equipped with such a sole. The sole base (1) comprises openings (4) in which the lugs (3) of the stretchable part (2) are positioned in a sealed manner. The insole (5) comprises a deformable structure (6) in its forepart. When the wearer's foot is put into a footwear article provided with such a complex, it exerts pressure on the edges of the upper (10) thus causing deformation of the sole, which avoids feelings of compression of the foot.

20 Claims, 3 Drawing Sheets

U.S. PATENT DOCUMENTS

| | | | |
|---|---|---|---|
| 3,748,756 | A | 7/1973 | White |
| 3,834,046 | A | 9/1974 | Fowler |
| 3,916,539 | A | 11/1975 | Pankin et al. |
| 3,952,430 | A | 4/1976 | Pankin et al. |
| 4,215,493 | A | 8/1980 | Antonious |
| 4,270,285 | A | 6/1981 | Antonious |
| 4,451,995 | A | 6/1984 | Antonious |
| 4,506,460 | A | 3/1985 | Rudy |
| 4,511,930 | A | 4/1985 | Lemelson |
| 4,541,184 | A | 9/1985 | Leighton |
| 4,559,723 | A | 12/1985 | Hamy et al. |
| 4,559,724 | A | 12/1985 | Norton |
| 4,590,123 | A | 5/1986 | Hashimoto et al. |
| 4,599,810 | A | 7/1986 | Sacre |
| 4,619,055 | A | 10/1986 | Davidson |
| 4,654,983 | A | 4/1987 | Graham et al. |
| 4,658,516 | A | 4/1987 | Beck |
| 4,724,624 | A | 2/1988 | Duclos |
| 4,910,887 | A | 3/1990 | Turner et al. |
| 4,944,099 | A | 7/1990 | Davis |
| 4,967,492 | A | 11/1990 | Rosen |
| 5,025,573 | A | 6/1991 | Giese et al. |
| 5,060,402 | A | 10/1991 | Rosen |
| 5,083,385 | A | 1/1992 | Halford |
| 5,203,097 | A | 4/1993 | Blair |
| 5,337,492 | A | 8/1994 | Anderie et al. |
| 5,367,791 | A | 11/1994 | Gross et al. |
| 5,367,792 | A | 11/1994 | Richard et al. |
| 5,423,135 | A | 6/1995 | Poole et al. |
| 5,499,459 | A | 3/1996 | Tomaro |
| 5,529,830 | A | 6/1996 | Dutta et al. |
| 5,555,650 | A | 9/1996 | Longbottom et al. |
| 5,566,475 | A | 10/1996 | Donnadieu |
| 5,659,914 | A | 8/1997 | Steinlauf |
| 5,725,823 | A | 3/1998 | Finn et al. |
| 5,727,271 | A | 3/1998 | Romanato et al. |
| 5,727,336 | A | 3/1998 | Ogden |
| 5,729,912 | A | 3/1998 | Gutkowski et al. |
| 5,765,296 | A | 6/1998 | Ludemann et al. |
| 5,804,011 | A | 9/1998 | Dutta et al. |
| 5,813,145 | A | 9/1998 | Prober |
| 5,815,949 | A | 10/1998 | Sessa |
| 5,829,171 | A | 11/1998 | Weber et al. |
| 5,879,725 | A | 3/1999 | Potter |
| 5,893,219 | A | 4/1999 | Smith et al. |
| 5,915,820 | A | 6/1999 | Kraeuter et al. |
| 5,940,990 | A | 8/1999 | Barret |
| 5,946,825 | A | 9/1999 | Koh et al. |
| 5,948,707 | A | 9/1999 | Crawley et al. |
| 5,956,868 | A | 9/1999 | Stevens et al. |
| 5,983,524 | A | 11/1999 | Polegato |
| 5,996,253 | A | 12/1999 | Spector |
| 6,029,376 | A | 2/2000 | Cass |
| 6,038,793 | A | 3/2000 | Kendall |
| 6,050,001 | A | 4/2000 | Ditrtrich |
| 6,065,230 | A | 5/2000 | James |
| 6,089,411 | A | 7/2000 | Baudin et al. |
| 6,105,279 | A | 8/2000 | Bouchoms |
| 6,115,945 | A | 9/2000 | Ellis, III |
| 6,119,373 | A | 9/2000 | Gebhard et al. |
| 6,122,844 | A | 9/2000 | Nunez |
| 6,138,385 | A | 10/2000 | Jungkind et al. |
| D433,560 | S | 11/2000 | Pawlus |
| 6,205,683 | B1 | 3/2001 | Clark et al. |
| 6,421,933 | B1 | 7/2002 | Zamprogno |
| 6,519,876 | B1 | 2/2003 | Geer et al. |
| 6,920,707 | B1 | 7/2005 | Greene et al. |
| 6,976,319 | B2 | 12/2005 | Pfander |
| 7,155,845 | B2 | 1/2007 | Durand |
| 7,621,058 | B2 * | 11/2009 | Durand ..... 36/97 |
| 2002/0088145 | A1 | 7/2002 | Clark et al. |
| 2005/0257405 | A1 | 11/2005 | Kilgore |

FOREIGN PATENT DOCUMENTS

| | | | |
|---|---|---|---|
| EP | 1383402 | B1 | 5/2005 |
| FR | 993360 | A | 10/1951 |
| FR | 1218101 | A | 5/1960 |
| FR | 2501480 | A1 | 9/1982 |
| FR | 2675349 | A1 | 10/1992 |
| FR | 2745552 | A1 | 9/1997 |
| WO | 90/06699 | A1 | 6/1990 |
| WO | 92/02155 | A1 | 2/1992 |
| WO | 96/18317 | A2 | 6/1996 |
| WO | 01/82733 | A1 | 11/2001 |
| WO | 02/051273 | A2 | 7/2002 |
| WO | 2005/077216 | A1 | 8/2005 |

OTHER PUBLICATIONS

Acor Orthopaedic, Inc., SPR [online], http: // www. acor.com/srp. htm, [retrieved on Jun. 5, 2001], pp. 1/2-2/2.

Bontex, Our Products [online], http: //bontex.com/products.html, [retrieved Jun. 4, 2001], pp. 1/2-2/2.

Case *Calzados Hergar / Exten.s and Manufacture Francaise des Chaussures ERAM* v. *TGI Paris*, 3rd Chamber, 1st Section / RG No. 06/10081, Calzados Hergar's Responsive and Recapitulative Brief No. 2—Hearing of Jul. 2, 2008 (translated excerpt).

Dakkak Brothers Company, Our Products: Microcellular Rubber Sheets, T.P.R.—Granules, EVA Compound, Rubber Compound [online], http: //www.dakkakco.com/productsl.html [retrieved on Jun. 7, 2001], pp. 1/3-3/3.

Excerpts from first instance decision dated Nov. 25, 2008 in lawsuit *Calzados Hergar / Exten.s and Manufacture Francaise des Chaussures ERAM* in a French Court: *TGI Paris*, 3rd Chamber, 1st Section / RG No. 06/10081, involving the French part of European patent No. EP 1,383,402 which is a French counterpart to the parent of this application.

Excerpts from patentee's appeal brief dated May 23, 2009 in Appeals Court of Paris.

International Preliminary Examination Report of PCT/US01/49381 (WO 02/051273).

U.S. Appl. No. 60/304,250 to Clark et al. filed Jul. 10, 2001.

U.S. Appl. No. 60/258,184 to Clark et al. filed Dec. 22, 2000.

Excerpts from appeal decision dated Nov. 25, 2008 in lawsuit *Calzados Hergar / Exten.s and Manufacture Francaise des Chaussures ERAM* in a French Court: Appeals Court of Paris, Pole 5, Chamber 1, involving the French part of European patent No. EP 1,383,402 which is a French counterpart to the grand-parent U.S. Appl. No. 10/475,933 of this application, with English translation.

Entry: Mizuno wave nexus 2007, twenga.fr (2007), with partial translation.

Entries: Polymer, Molecule, Covalent link, Physics of solids, Elasticity, Wikipedia, fr.wikipedia.org (2007), with partial translation.

* cited by examiner

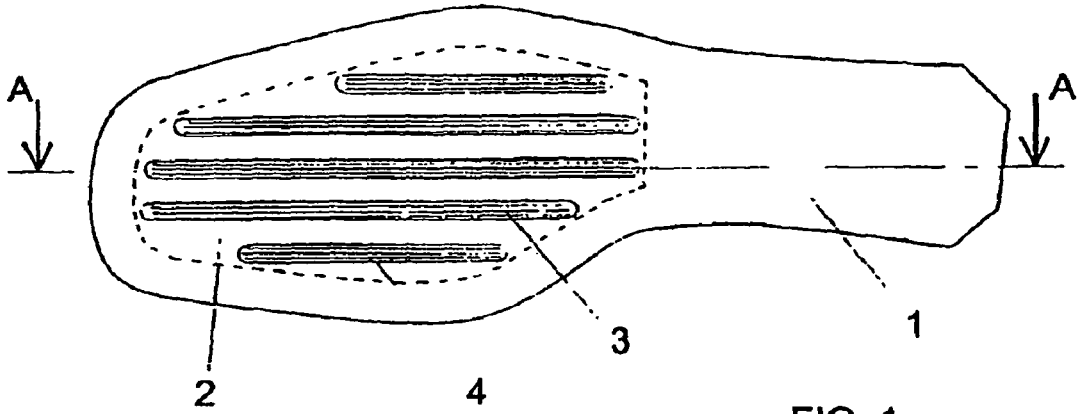
FIG. 1
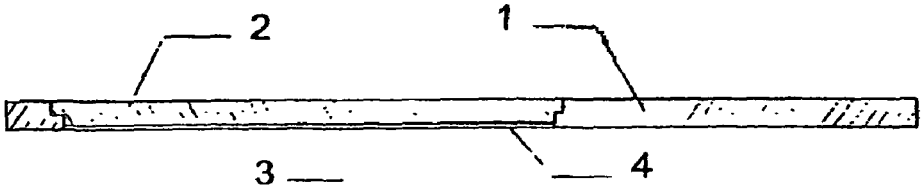
FIG. 2 - SECTION A-A

SOLE WITH EXTENSIBLE STRUCTURE

This application is a continuation of U.S. application Ser. No. 11/603,150 filed Nov. 22, 2006, which is a continuation of U.S. application Ser. No. 10/475,933 filed Oct. 27, 2003, which is a national stage of PCT/FR02/01366 filed Apr. 22, 2002.

The present invention relates to a sole of a shoe making it possible for different foot widths to be fitted easily; it also relates to the shoe equipped with such a sole together with the method for assembling this shoe.

Usually shoes are manufactured with a width chosen by the manufacturer. This width may be bigger or smaller but it is predetermined; it does not vary as a function of the width of the wearer's foot.

It is also known how to adapt to several foot widths by manufacturing an upper part in elastic material, but without being able to enlarge the lower part in contact with the sole.

The device according to the invention makes it possible to remedy these disadvantages. In fact, according to a first specification, it comprises a sole with at least one stretchable area in the forepart of the foot; thus, when worn, the manufactured shoe fits the anatomic width of the foot on its lower part.

In the shoe sole according to the invention, the transversally stretchable forepart is obtained by moulding (or gluing), on a sole base, one or several inserts of a material with deformable structure possessing an elasticity potential and a shape memory adapted to the comfort required. This stretchable insert is flat on the upper face and provided with one or several lugs on the lower face.

These lugs are intended to be set countersunk in the base of the sole. According to another specification, the sole base is manufactured from a classic type of material such as leather, elastomer, rubber, polyurethane or any other material used traditionally for the manufacture of shoe soles and possessing the normal abrasion resistance specifications.

According to another specification, the base of the sole comprises openings intended to receive the lugs of the lower face of the stretchable insert, while still preserving the sealing of the link between the two materials. According to another specification, an insole is constituted of one or several cut-out zones in the forepart of the foot and a rigid back part.

This structure of the forepart of the insole allows transversal deformation of the forepart zone.

Other embodiments of the insole can be envisaged. The deformable part of the forepart can be made simply by juxtaposition of longitudinal slits. According to another embodiment, the deformable part of the forepart can be obtained by producing one or several longitudinal openings, these being filled or not by moulding or gluing one or several inserts of stretchable material.

The invention also concerns the footwear article equipped with the stretchable sole as described above. According to a preferred embodiment, this footwear article is constituted of an upper, the insole with a deformable forepart and a rigid back part, of a non-glued sock lining in its peripheral part and of the stretchable insert sole according to the present invention.

When the user tries on a footwear article provided with such a complex, the foot exerts pressure on the edges of the upper, causing deformation of the insole and the sole. This ability of the sole and the insole to be deformed avoids any feeling of the foot being compressed.

The method of assembling this footwear article consists of preparing an insole with a rigid back part and a deformable part in the forepart area of the foot. Using a standard width last, the upper is mounted on said insole and glued on the sole equipped with its stretchable insert. Finally, the insole is set inside the shoe.

The invention is illustrated, without being limited in any way, by the description of a preferred embodiment, provided only as an example and shown in the attached drawings in which FIG. 1 represents the sole as seen from above.

FIG. 2 shows a longitudinal section of the sole.

Figure 3:
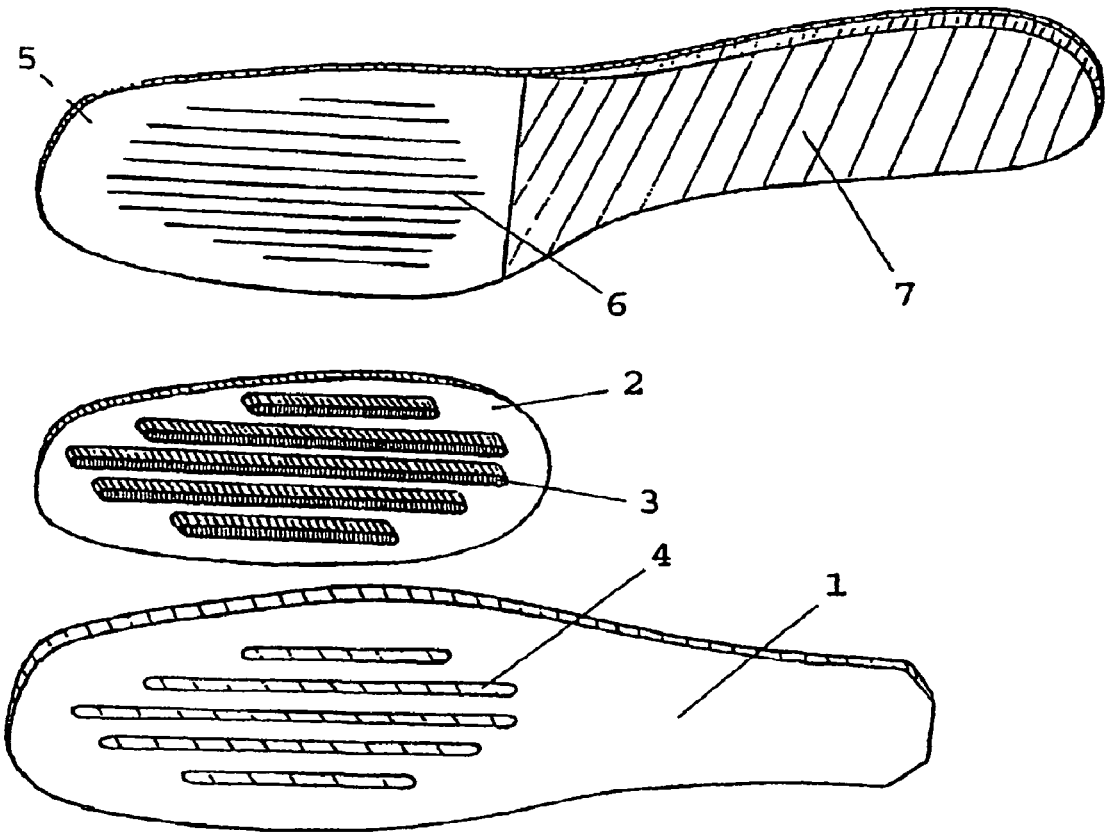
FIG. 3 shows an exploded view of the sole base, elastic insert and insole as a whole.

The sole shown in FIGS. 1 and 2 is constituted of a sole base 1 and of an insert in stretchable material 2, assembled by moulding or by gluing to ensure that there is a seal between the two materials. The lugs 3 of the stretchable insert are positioned in the openings 4 made in the base of the sole.

In the embodiment example shown, this type of implantation in parallel allows the addition of the elastic properties of each lug 3. This complex, with rigid sole base and stretchable insert makes it possible to obtain a sole that is sufficiently structured to be adapted to traditional soldering manufacture.

FIG. 3 shows a stack of independent supports with deformable and stretchable properties. The sole base 1 in rigid material is made deformable through the openings 4 made in the forepart area.

The insert 2 with lugs 3 which have been countersunk in the openings 4 of the sole base 1 is a stretchable sealed joint.

The insole 5 is equipped with a foot forepart made deformable by the presence of longitudinal slits 6 and a rigid back part 7.

Figure 4:
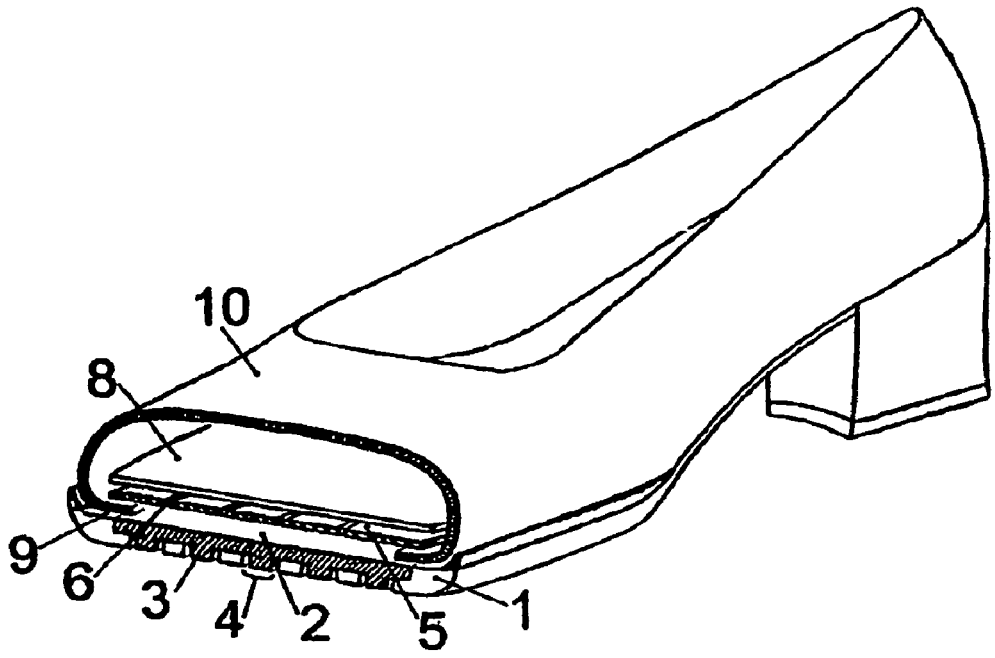
FIG. 4 shows a section in perspective of a shoe equipped with the system.

In the embodiment as a whole shown in FIG. 4, this configuration makes it possible to maintain elasticity at every stage once the assembly has been completed. The sole base 1, the insert 2 and the insole 5 possess stretchable properties outside the gluing zones 9.

The sock lining 8, non-glued at the periphery, does not block the deformation of the lower layers.

It is the pressure of the foot on the external edges of the upper 10 which produces the deformation of the superposed stretchable layers as a whole.

As a non-limiting example, the dimensions of the insert at the level of the lugs should be of the order of 3.5 mm in thickness and 7 mm in width.

It should be understood that these dimensions are only provided as indications; they can vary in function of the size and comfort required for the shoe.

This shoe structure provides walking comfort suitable, in particular, for "sensitive feet items", but evidently this stretchable structure can be envisaged for other types of assembly besides soldering or other types of footwear.

The present invention is intended, in particular, for the manufacture of shoes with the ability to adapt to varying foot widths.

The invention claimed is:

1. Stretchable sole for a shoe, said sole comprising:

a sole base having attachment zones for attachment of said base to edges of an upper, and an insert mounted to said sole base between the attachment zones, wherein said insert is relatively stretchable transversally as compared to the sole base, wherein said insert is made of a deformable material with shape memorization, wherein said insert is provided with at least one lug on its lower surface and a forepart of said sole base is provided with at least one opening into which the at least one lug is countersunk, wherein said at least one opening extends continuously substantially from a toe area substantially to an arch area of the sole base, so that the sole stretches transversally to accommodate differing foot widths.

2. Stretchable sole according to claim 1, wherein the insert is glued or soldered by injection on the sole base.

3. Footwear comprising a stretchable sole according to claim 2 and an upper attached to the sole.

4. Stretchable sole according to claim 1, wherein the sole base has properties suitable for gripping.

5. Footwear comprising a stretchable sole according to claim 1 and an upper attached to the sole.

6. Footwear according to claim 5, further comprising an insole, wherein the insole has a deformable forepart and a rigid back part.

7. Footwear according to claim 6, wherein the deformable forepart of the insole comprises at least one longitudinal slit or cut-out zone.

8. Footwear according to claim 7, wherein the deformable forepart of the insole comprises several parallel longitudinal slits or cut-out zones.

9. Stretchable sole according to claim 1, wherein the insert is glued or molded to the base.

10. Stretchable sole according to claim 1, wherein the sole comprises a plurality of inserts made of deformable material with shape memorization attached to the sole base.

11. Footwear comprising a stretchable sole according to claim 10 and an upper attached to the sole.

12. Stretchable sole according to claim 1, wherein the insert has a flat upper surface.

13. Footwear comprising a stretchable sole according to claim 12 and an upper attached to the sole.

14. Stretchable sole according to claim 1, wherein the insert is assembled to the base so as to ensure a seal between the insert and the base.

15. Footwear comprising a stretchable sole according to claim 14 and an upper attached to the sole.

16. Stretchable sole according to claim 1, wherein the base is glued or molded on the insert.

17. Stretchable sole according to claim 1, wherein the at least one opening is filled with the at least one insert.

18. Footwear comprising a stretchable sole according to claim 17 and an upper attached to the sole.

19. Stretchable sole according to claim 17, wherein the sole has a flat upper surface.

20. Stretchable sole according to claim 1, wherein said insert is provided with a single lug on its lower surface and a forepart of said sole base is provided with a single opening into which the lug is countersunk.

* * * * *